US012305365B2

(12) United States Patent
Vasicek et al.

(10) Patent No.: US 12,305,365 B2
(45) Date of Patent: May 20, 2025

(54) IMMOBILIZATION OF ELECTROHYDRAULIC POWER MACHINE

(71) Applicant: Doosan Bobcat North America, Inc., West Fargo, ND (US)

(72) Inventors: Bohuslav Vasicek, Prague (CZ); Vaclav Schornik, Milevsko (CZ)

(73) Assignee: Doosan Bobcat North America, Inc., West Fargo, ND (US)

( * ) Notice: Subject to any disclaimer, the term of this patent is extended or adjusted under 35 U.S.C. 154(b) by 533 days.

(21) Appl. No.: 17/442,902

(22) PCT Filed: Mar. 25, 2020

(86) PCT No.: PCT/US2020/024665
§ 371 (c)(1),
(2) Date: Sep. 24, 2021

(87) PCT Pub. No.: WO2020/198330
PCT Pub. Date: Oct. 1, 2020

(65) Prior Publication Data

US 2022/0195700 A1 Jun. 23, 2022

Related U.S. Application Data

(60) Provisional application No. 62/823,098, filed on Mar. 25, 2019.

(51) Int. Cl.
*E02F 9/00* (2006.01)
*E02F 9/20* (2006.01)
(Continued)

(52) U.S. Cl.
CPC ..... *E02F 9/207* (2013.01); *E02F 9/24* (2013.01); *E02F 3/325* (2013.01); *E02F 9/2004* (2013.01);
(Continued)

(58) Field of Classification Search
CPC ... E02F 9/207; E02F 9/24; E02F 3/325; E02F 9/2004; E02F 9/2221; E02F 9/2267; E02F 9/2271; E02F 9/2075
See application file for complete search history.

(56) References Cited

U.S. PATENT DOCUMENTS 4,365,687 A 12/1982 Bauer
4,398,618 A 8/1983 Hansen
(Continued)

FOREIGN PATENT DOCUMENTS

CN 102348875 A 2/2012
CN 102971466 A 3/2013
(Continued)

OTHER PUBLICATIONS

Rejection Decision, for Chinese Patent Application No. 202080024290.7, dated Dec. 26, 2023, 20 pages.
(Continued)

*Primary Examiner* — Anne Marie Antonucci
*Assistant Examiner* — Jordan T Smith
(74) *Attorney, Agent, or Firm* — Westman Champlin & Koehler, P.A.

(57) ABSTRACT

Power machines having an electric power source and a controller configured to provide improved immobilization of power machine functions when an operator is not present or properly positioned within an operator station or compartment of the power machine.

14 Claims, 5 Drawing Sheets

(51) Int. Cl.
*E02F 9/24* (2006.01)
*E02F 3/32* (2006.01)
*E02F 9/22* (2006.01)

(52) U.S. Cl.
CPC ..... *E02F 9/2221* (2013.01); *E02F 9/2267* (2013.01); *E02F 9/2271* (2013.01)

(56) References Cited

U.S. PATENT DOCUMENTS

| | | | | |
|---|---|---|---|---|
| 5,931,254 | A | 8/1999 | Loraas et al. | |
| 6,186,260 | B1 | 2/2001 | Schenck et al. | |
| 6,202,014 | B1 | 3/2001 | Brandt et al. | |
| 6,226,902 | B1 | 5/2001 | Heyne | |
| 8,589,038 | B2 | 11/2013 | Hagiwara et al. | |
| 8,700,275 | B2 | 4/2014 | Edamura et al. | |
| 9,057,173 | B2 | 6/2015 | Hiroki et al. | |
| 10,633,830 | B2 | 4/2020 | Shibamori et al. | |
| 2001/0007087 | A1* | 7/2001 | Brandt | E02F 3/431 172/12 |
| 2004/0016586 | A1* | 1/2004 | Dvorak | E02F 9/2275 180/272 |
| 2004/0136821 | A1 | 7/2004 | Berger et al. | |
| 2007/0073465 | A1* | 3/2007 | Brown | E02F 9/207 701/50 |
| 2007/0203630 | A1 | 8/2007 | Vitale et al. | |
| 2011/0231046 | A1 | 9/2011 | Bissontz | |
| 2012/0003069 | A1 | 1/2012 | Hagiwara et al. | |
| 2013/0243557 | A1 | 9/2013 | Hiroki et al. | |
| 2013/0311052 | A1 | 11/2013 | Edamura et al. | |
| 2018/0245313 | A1 | 8/2018 | Shibamori et al. | |
| 2021/0062471 | A1* | 3/2021 | Kaneda | E02F 9/2235 |
| 2021/0086618 | A1* | 3/2021 | Kaneda | E02F 3/325 |

FOREIGN PATENT DOCUMENTS

| | | | |
|---|---|---|---|
| CN | 103443363 | A | 12/2013 |
| CN | 107923155 | A | 4/2018 |
| EP | 2 626 474 | A1 | 8/2013 |
| JP | 2012021362 | A | 2/2012 |
| JP | 2013253409 | A | 12/2013 |
| JP | 2016132967 | A | 7/2016 |
| WO | 2013183461 | A1 | 12/2013 |
| WO | 2016/117490 | A1 | 7/2016 |

OTHER PUBLICATIONS

Communication pursuant to Article 94(3) EPC, for European Patent Application No. 20718119.9, dated Feb. 23, 2023, 8 pages.
First Office Action, including Search Report, for Chinese Patent Application No. 202080024290.7, dated Sep. 13, 2022, 20 pages.
International Search Report and Written Opinion for International Application No. PCT/US2020/024665, mailed on Jun. 23, 2020, 14 pages.

* cited by examiner

IMMOBILIZATION OF ELECTROHYDRAULIC POWER MACHINE

CROSS-REFERENCE TO RELATED APPLICATION

This Application is a Section 371 National Stage Application of International Application No. PCT/US2020/024665, filed 25 Mar. 2020, and published as WO 2020/198330 A1, on 1 Oct. 2020, in English, the contents of which are hereby incorporated by reference in their entirety.

BACKGROUND

This disclosure is directed toward power machines. More particularly, this disclosure is directed to power machines having systems that enable one or more functions of the power machine after an operator performs an initialization routine.

Power machines, for the purposes of this disclosure, include any type of machine that generates power for the purpose of accomplishing a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include excavators, loaders, utility vehicles, tractors, and trenchers, to name a few examples.

Power machines sometimes include control systems that require an operator perform an initialization routine before some functions of the machine are activated. For example, some power machines with hydraulic systems that power travel functions and work functions include sensors that detect the presence of the operator in a seat of a cab, detect whether a safety bar or other restraint is in a lowered or protective position, and/or detect a seatbelt or restraint engagement status. In addition, some power machines can also include or alternatively include one or more operator inputs such as switches that an operator can manipulate as part of an initialization routine. While an engine drives one or more hydraulic pumps, hydraulic fluid from the pumps may be prevented by a valve from being provided to travel motors or other actuators until the operator has performed an initialization routine that can include activating some or all of the sensors and operator inputs discussed above.

The discussion above is merely provided for general background information and is not intended to be used as an aid in determining the scope of the claimed subject matter.

SUMMARY

Disclosed embodiments provide improved immobilization of power machine functions when an operator has not performed an initialization routine required by systems on the power machine. The disclosed embodiments include power machines having an electric power source. In exemplary embodiments, the electric power source can be used to power hydraulic actuators using an electro-hydraulic system. In disclosed power machines, power machine function enablement can be achieved while also reducing power consumption, reducing or eliminating hydraulic components required to prevent enablement of these machine functions until the operator has performed an initialization routine required by systems.

One general aspect of a disclosed embodiment includes a power machine (100; 200; 400; 500; 600) including: a frame (110; 210) including an operator station (150; 250) configured to provide an operating position for an operator of the work machine; at least one actuator (440) configured to perform a machine work function; an operator input (256; 406) configured to be manipulated by the operator and to responsively provide an operator command signal (408) to command usage of the at least one actuator to perform the work function; at least one operator engagement sequence input (402) configured to provide an enablement signal (404) indicative of whether the operator is engaged or positioned such that machine work function can be activated or enabled; an electric power source (420) supported by the frame and configured to provide a power source output; a power conversion system (430) coupled to the power source and configured to receive the power source output and to utilize the power source output to provide power signals (432) to the at least one actuator (440) to cause the at least one actuator to perform the machine work function; and a controller (410) configured to receive the operator command signal and the engagement sequence output and to responsively provide control signals (412; 512; 514) to the electric power source to control the power source output, where the controller is further configured such that if the engagement sequence output is indicative of a proper operator enablement action, the controller generates, responsive to the operator command signal commanding usage of the at least one actuator, the control signals to control the electric power source to provide power to the power conversion system to provide the power signals to the at least one actuator and perform the commanded usage of the at least one actuator, where the controller is further configured such that if the engagement sequence output is not indicative of the proper operator enablement action, the controller generates the control signals to control the electric power source to not provide power to the power conversion system regardless of the commanded usage indicated by the operator command output.

Implementations may include one or more of the following features. The power machine where power source output of the electric power source includes a rotating shaft of an electric motor (528), and where the power conversion system is coupled to the rotating shaft and configured to provide the power signals (432) in the form of pressurized hydraulic fluid. The power machine where the power conversion system includes: a hydraulic pump (630) coupled to the rotating shaft of the electric motor and configured to provide the pressurized hydraulic fluid; and a hydraulic valve (634) coupled to the hydraulic pump and configured to control the application of the power signals to the at least one actuator responsive to the operator command output.

The power machine where the electric power source further includes battery components (524) coupled to the electric motor, and where the control signals include battery control signals (512) to control the battery components and generating control signals (514) to control the electric motor.

The power machine where the at least one operator engagement sequence input includes at least one of an operator seat or position sensor, a safety bar position sensor, and a seat belt engagement sensor. The power machine where the at least one operator engagement sequence input includes a sensor or input device positioned in the operator station and configured to provide the engagement sequence output as an indication of the operator's presence in the operator station. The power machine where the operator input is positioned in the operator station.

The power machine where the at least one actuator includes at least one of a travel motor, a lift cylinder and a tilt cylinder.

One general aspect of another embodiment includes a power machine (100; 200; 400; 500; 600) including: at least one hydraulic actuator (440) configured to perform a machine work function; an operator input (256; 406) configured to be manipulated by an operator and to responsively provide an operator command signal (408) to command usage of the at least one actuator to perform the work function; an operator engagement sequence input (402) configured to provide an enablement signal (404) indicative of whether the operator is engaged or positioned such that machine work function can be activated or enabled; an electric power source (420) including an electric motor and configured to provide a power source output in the form of a rotating shaft; a power conversion system (430) coupled to the rotating shaft and configured to provide power signals (432) in the form of pressurized hydraulic fluid to the at least one hydraulic actuator (440) to cause the at least one actuator to perform the machine work function; and a controller (410) configured to receive the operator command signal and the engagement sequence output and to responsively provide control signals (412; 512; 514) to the electric power source to control the power source output, where the controller is further configured such that if the engagement sequence output is indicative of a proper operator enablement action, the controller generates, responsive to the operator command signal commanding usage of the at least one actuator, the control signals to control the electric power source to provide power to the power conversion system to provide the power signals to the at least one actuator and perform the commanded usage of the at least one actuator, where the controller is further configured such that if the engagement sequence output is not indicative of the proper operator enablement action, the controller generates the control signals to control the electric power source to not provide power to the power conversion system regardless of the commanded usage indicated by the operator command output.

Implementations may include one or more of the following features. The power machine where the power conversion system includes a hydraulic pump (630) coupled to the rotating shaft of the electric motor and configured to provide the pressurized hydraulic fluid. The power machine where the power conversion system further includes a hydraulic valve (634) coupled to the hydraulic pump and configured to control the application of the power signals to the at least one hydraulic actuator responsive to the operator command output.

The power machine where the electric power source further includes battery components (524) coupled to the electric motor and configured to provide electric power to the electric motor, and where the control signals include battery control signals (512) to control the battery components and generating control signals (514) to control the electric motor.

The power machine and further including a frame (110; 210) including an operator station (150; 250) configured to provide an operating position for an operator of the work machine, where the operator input is positioned in the operator station. The power machine where the at least one operator engagement sequence input is configured to provide the engagement sequence output as an indication of the operator's presence in the operator station. The power machine where the at least one operator engagement sequence input includes at least one of an operator seat or position sensor, a safety bar position sensor, and a seat belt engagement sensor. The power machine where the at least one operator engagement sequence input includes a push button.

The power machine where the at least one hydraulic actuator includes at least one of a travel motor, a lift cylinder and a tilt cylinder.

One general aspect of another embodiment includes a power machine (100; 200; 400; 500; 600) including: a frame (110; 210) including an operator station (150; 250) configured to provide an operating position for an operator of the work machine; at least one actuator (440) configured to perform a machine work function; an operator input (256; 406) configured to be manipulated by the operator and to responsively provide an operator command signal (408) to command usage of the at least one actuator to perform the work function; an electric power source (420) supported by the frame and operably coupled to the actuator and configured to selectively provide a power source output to the actuator; a controller (410) configured to receive the operator command signal and at least one enablement signal (404) and determine whether an operator has performed a proper enablement action, and to responsively provide control signals (412; 512; 514) to the electric power source to control the power source output, where the controller is further configured such that if the enablement signal is indicative of a proper operator enablement action, the controller generates, responsive to the operator command signal commanding usage of the at least one actuator, the control signals to control the electric power source to provide power signals to the at least one actuator and perform the commanded usage of the at least one actuator, where the controller is further configured such that if the enablement signal is not indicative of the proper operator enablement action, the controller generates the control signals to control the electric power source to not provide power signals to the at least one actuator regardless of the commanded usage indicated by the operator command output.

Implementations may include one or more of the following features. The power machine where power source output of the electric power source includes a rotating shaft of an electric motor (528), and further including a power conversion system that is coupled to the rotating shaft and configured to provide power signals (432) in the form of pressurized hydraulic fluid to the at least one actuator.

The power machine where the power conversion system includes: a hydraulic pump (630) coupled to the rotating shaft of the electric motor and configured to provide the pressurized hydraulic fluid; and a hydraulic valve (634) coupled to the hydraulic pump and configured to control the application of the power signals to the at least one actuator responsive to the operator command output.

The power machine where the controller is further configured such that if the operator command signal is indicative of no manipulation by the operator, the controller generates the control signals to control the electric power source to not provide power regardless of the enablement signal.

The power machine where the electric power source further includes battery components (524) coupled to the electric motor, and including control signals (514) to control the electric motor.

The power machine where the at least one operator engagement sequence input includes at least one of an operator seat or position sensor, a safety bar position sensor, and a seat belt engagement sensor. The power machine where the at least one operator engagement sequence input includes a sensor or input device positioned in the operator station and configured to provide the engagement sequence output as an indication of the operator's presence in the operator station. The power machine and further including an operator interface configured to alert the operator of a status of the enablement signal.

One general aspect in accordance with another embodiment includes a power machine (100; 200; 400; 500; 600) including: at least one hydraulic actuator (440) configured to perform a machine work function; an operator input (256; 406) configured to be manipulated by an operator and to responsively provide an operator command signal (408) to command usage of the at least one actuator to perform the work function; an operator engagement sequence input (402) configured to provide an enablement signal (404) indicative of whether the operator is engaged or positioned such that machine work function can be activated or enabled; an electric power source (420) including an electric motor and configured to provide a power source output in the form of a rotating shaft; a power conversion system (430) coupled to the rotating shaft and configured to selectively provide power signals (432) in the form of pressurized hydraulic fluid to the at least one hydraulic actuator (440) to cause the at least one actuator to perform the machine work function; and a controller (410) configured to receive the operator command signal and the engagement sequence signal and to responsively provide control signals (412; 512; 514) to the electric power source to control the power source output, where the controller is further configured such that if the engagement sequence signal is indicative of a proper operator enablement action, the controller generates the control signals, responsive to the operator command signal commanding usage of the at least one actuator, to control the electric power source to provide power to the power conversion system to provide the power signals to the at least one actuator and perform the commanded usage of the at least one actuator, and where the controller is further configured such that if the engagement sequence signal is not indicative of the proper operator enablement action, the controller generates the control signals to control the electric power source to not provide power to the power conversion system regardless of the commanded usage indicated by the operator signal.

Implementations may include one or more of the following features. The power machine where the power conversion system includes a hydraulic pump (630) coupled to the rotating shaft of the electric motor and configured to provide the pressurized hydraulic fluid. The power machine where the power conversion system further includes a hydraulic valve (634) coupled to the hydraulic pump and configured to control the application of the power signals to the at least one hydraulic actuator responsive to the operator signal.

The power machine where the electric power source further includes battery components (524) coupled to the electric motor and configured to provide electric power to the electric motor, and where the control signals include control signals (514) to control the electric motor.

The power machine and further including a frame (110; 210) including an operator station (150; 250) configured to provide an operating position for an operator of the work machine, where the operator input is positioned in the operator station. The power machine where the at least one operator engagement sequence input is configured to provide the engagement sequence output as an indication of the operator's presence in the operator station. The power machine where the at least one operator engagement sequence input includes at least one of an operator seat or position sensor, a safety bar position sensor, and a seat belt engagement sensor.

This Summary and the Abstract are provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Disclosed embodiments provide improved immobilization of power machine functions, such as travel, swing, blade, lift and tilt functions until an operator has performed an initialization routine required by systems on the power machine. The disclosed embodiments are particularly directed to electric, hybrid-electric, and electro-hydraulic powered machines. Using disclosed concepts, for example in electro-hydraulic powered machines, selective machine function enablement can be achieved while also reducing power consumption, reducing or eliminating hydraulic components required to provide enablement of these machine functions.

Figure 2:
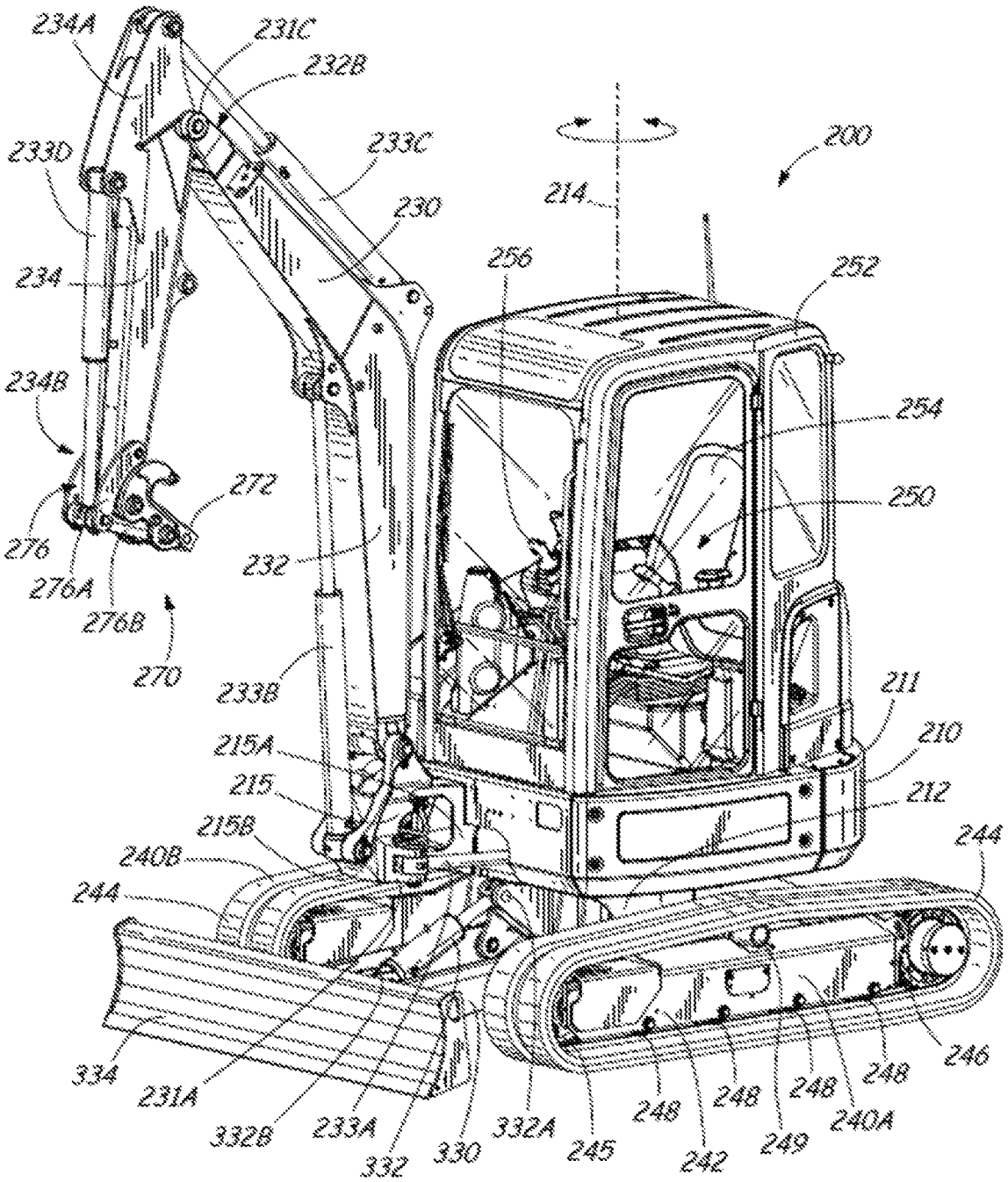
FIG. 2 is a front left perspective view of a representative power machine in the form of an excavator on which the disclosed embodiments can be practiced.
Figure 3:
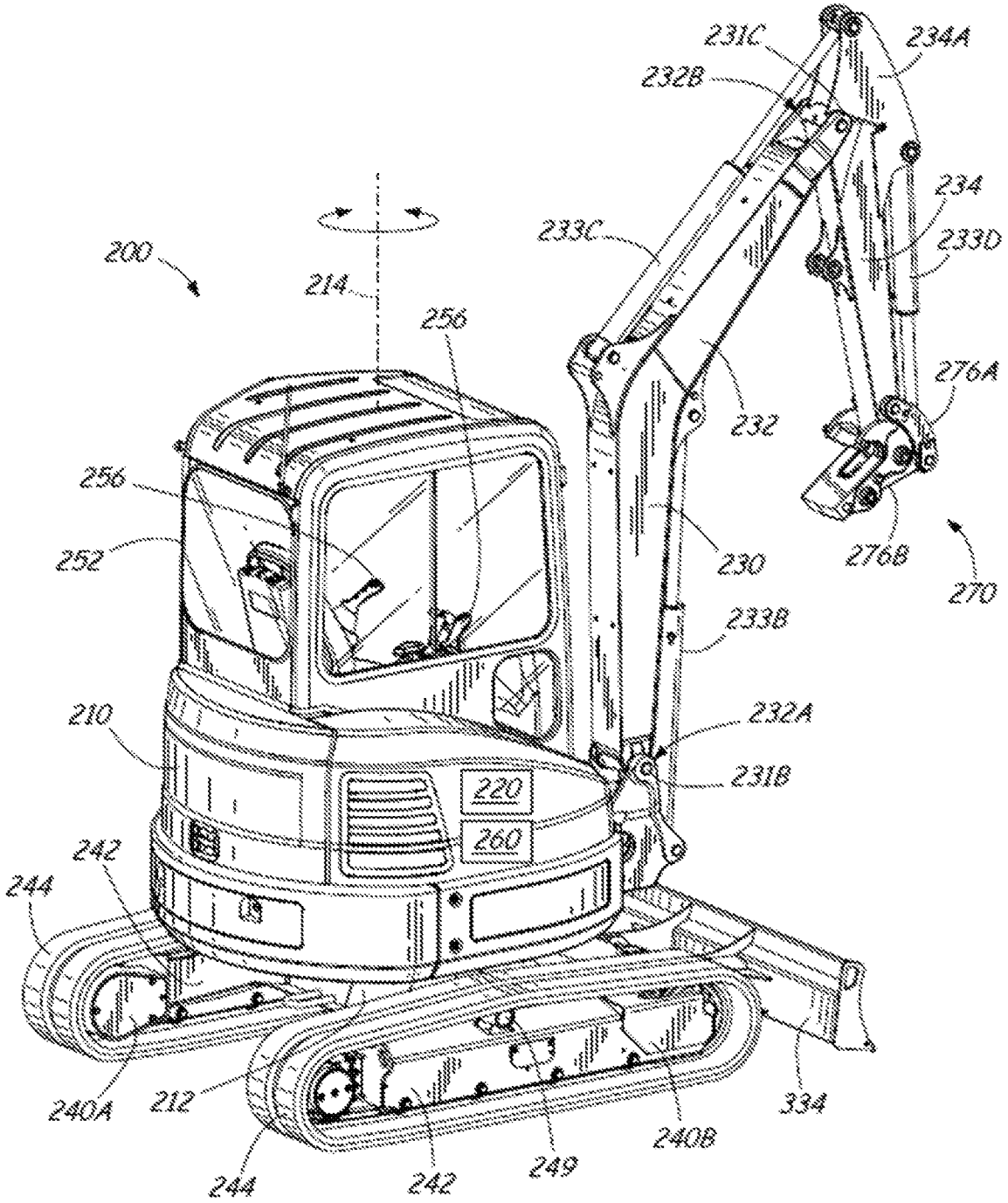
FIG. 3 is a rear right perspective view of the excavator of FIG. 2.

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is discussed. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that is capable of providing power to the work element to accomplish a work task. One type of power machine is a self-propelled work vehicle. Self-propelled work vehicles are a class of power machines that include a frame, work element, and a power source that is capable of providing power to the work element. At least one of the work elements is a motive system for moving the power machine under power. Disclosed embodiments can be utilized in power machines, such as excavators and loaders that utilize an electric or hybrid electric power source to power machine functions, for example through an electrically powered hydraulic system.

Figure 1:
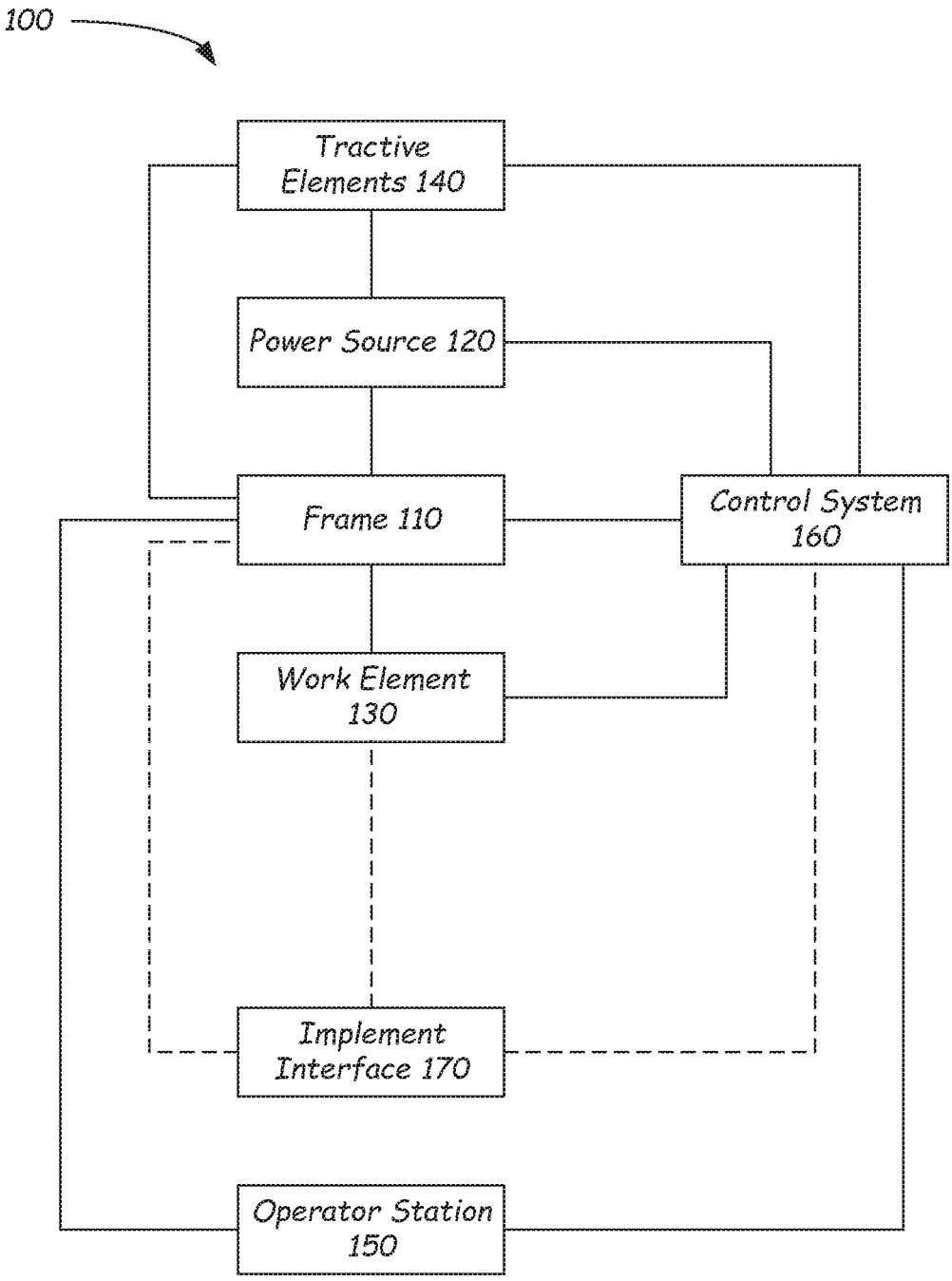
FIG. 1 is a block diagram illustrating functional systems of a representative power machine on which embodiments of the present disclosure can be practiced.

Referring now to FIG. 1, a block diagram illustrates the basic systems of a power machine 100 upon which the embodiments discussed below can be advantageously incorporated and can be any of a number of different types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that are capable of performing a dedicated task. For example, some work vehicles have a lift arm to which an implement such as a bucket is attached such as by a pinning arrangement. The work element, i.e., the lift arm can be manipulated to position the implement for the purpose of performing the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that is capable of moving with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is capable of providing power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is capable of converting the output from an engine into a form of power that is usable by a work element. Other types of power sources can be incorporated into power machines, including electrical sources or a combination of power sources, known generally as hybrid power sources. In particular, exemplary embodiments utilize power sources 120 that include an electrical power source, such as one or more batteries.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, wheels attached to an axle, track assemblies, and the like. Tractive elements can be rigidly mounted to the frame such that movement of the tractive element is limited to rotation about an axle or steerably mounted to the frame to accomplish steering by pivoting the tractive element with respect to the frame.

Power machine 100 includes an operator station 150, which provides a position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e. from a remotely located operator station) instead of or in addition to an operator station adjacent or on the power machine. This can include applications where at least some of the operator controlled functions of the power machine can be operated from a operating position associated with an implement that is coupled to the power machine. Alternatively, with some power machines, a remote control device can be provided (i.e. remote from both of the power machine and any implement to which is it coupled) that is capable of controlling at least some of the operator controlled functions on the power machine.

FIGS. 2-3 illustrate an excavator 200, which is one particular example of a power machine of the type illustrated in FIG. 1, on which the disclosed embodiments can be employed. Unless specifically noted otherwise, embodiments disclosed below can be practiced on a variety of power machines, with the excavator 200 being only one of those power machines. Excavator 200 is described below for illustrative purposes. Not every excavator or power machine on which the illustrative embodiments can be practiced need have all of the features or be limited to the features that excavator 200 has. Excavator 200 has a frame 210 that supports and encloses a power system 220 (represented in FIGS. 2-3 as a block, as the actual power system is enclosed within the frame 210). The power system 220 can include an engine that aids in providing a power output to a hydraulic system, but generally includes an electric, or hybrid electric power source for providing the output to the hydraulic system. The hydraulic system acts as a power conversion system that includes one or more hydraulic pumps for selectively providing pressurized hydraulic fluid to actuators that are operably coupled to work elements in response to signals provided by operator input devices. The hydraulic system also includes a control valve system that selectively provides pressurized hydraulic fluid to actuators in response to signals provided by operator input devices. The excavator 200 includes a plurality of work elements in the form of a first lift arm structure 230 and a second lift arm structure 330 (not all excavators have a second lift arm structure). In addition, excavator 200, being a work vehicle, includes a pair of tractive elements in the form of left and right track assemblies 240A and 240B, which are disposed on opposing sides of the frame 210.

An operator compartment 250 is defined in part by a cab 252, which is mounted on the frame 210. The cab 252 shown on excavator 200 is an enclosed structure, but other operator compartments need not be enclosed. For example, some excavators have a canopy that provides a roof but is not enclosed A control system, shown as block 260 is provided for controlling the various work elements. Control system 260 includes operator input devices, which interact with the power system 220 to selectively provide power signals to actuators to control work functions on the excavator 200.

Frame 210 includes an upper frame portion or house 211 that is pivotally mounted on a lower frame portion or undercarriage 212 via a swivel joint. The swivel joint includes a bearing, a ring gear, and a slew motor with a pinion gear (not pictured) that engages the ring gear to swivel the machine. The slew motor receives a power signal from the control system 260 to rotate the house 211 with respect to the undercarriage 212. House 211 is capable of unlimited rotation about a swivel axis 214 under power with respect to the undercarriage 212 in response to manipulation of an input device by an operator. Hydraulic conduits are fed through the swivel joint via a hydraulic swivel to provide pressurized hydraulic fluid to the tractive elements and one or more work elements such as lift arm 330 that are operably coupled to the undercarriage 212.

The first lift arm structure 230 is mounted to the house 211 via a swing mount 215. (Some excavators do not have a swing mount of the type described here.) The first lift arm structure 230 is a boom-arm lift arm of the type that is generally employed on excavators although certain features of this lift arm structure may be unique to the lift arm illustrated in FIGS. 2-3. The swing mount 215 includes a frame portion 215A and a lift arm portion 215B that is rotationally mounted to the frame portion 215A at a mounting frame pivot 231A. A swing actuator 233A is coupled to the house 211 and the lift arm portion 215B of the mount. Actuation of the swing actuator 233A causes the lift arm structure 230 to pivot or swing about an axis that extends longitudinally through the mounting frame pivot 231A.

The first lift arm structure 230 includes a first portion, known generally as a boom 232 and a second portion known as an arm or a dipper 234. The boom 232 is pivotally attached on a first end 232A to mount 215 at boom pivot mount 231B. A boom actuator 233B is attached to the mount 215 and the boom 232. Actuation of the boom actuator 233B causes the boom 232 to pivot about the boom pivot mount 231B, which effectively causes a second end 232B of the boom to be raised and lowered with respect to the house 211. A first end 234A of the arm 234 is pivotally attached to the second end 232B of the boom 232 at an arm mount pivot 231C. An arm actuator 233C is attached to the boom 232 and the arm 234. Actuation of the arm actuator 233C causes the arm to pivot about the arm mount pivot 231C. Each of the swing actuator 233A, the boom actuator 233B, and the arm actuator 233C can be independently controlled in response to control signals from operator input devices.

An exemplary implement interface 270 is provided at a second end 234B of the arm 234. The implement interface 270 includes an implement carrier 272 that is capable of accepting and securing a variety of different implements to the lift arm 230. Such implements have a machine interface that is configured to be engaged with the implement carrier 272. The implement carrier 272 is pivotally mounted to the second end 234B of the arm 234. An implement carrier actuator 233D is operably coupled to the arm 234 and a linkage assembly 276. The linkage assembly includes a first link 276A and a second link 276B. The first link 276A is pivotally mounted to the arm 234 and the implement carrier actuator 233D. The second link 276B is pivotally mounted to the implement carrier 272 and the first link 276A. The linkage assembly 276 is provided to allow the implement carrier 272 to pivot about the arm 234 when the implement carrier actuator 233D is actuated.

The implement interface 270 also includes an implement power source (not shown in FIGS. 2-3) available for connection to an implement on the lift arm structure 230. The implement power source includes pressurized hydraulic fluid port to which an implement can be coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The electrical power source can also include electrical conduits that are in communication with a data bus on the excavator 200 to allow communication between a controller on an implement and electronic devices on the excavator 200. It should be noted that the specific implement power source on excavator 200 does not include an electrical power source.

The lower frame 212 supports and has attached to it a pair of tractive elements 240, identified in FIGS. 2-3 as left track drive assembly 240A and right track drive assembly 240B. Each of the tractive elements 240 has a track frame 242 that is coupled to the lower frame 212. The track frame 242 supports and is surrounded by an endless track 244, which rotates under power to propel the excavator 200 over a support surface. Various elements are coupled to or otherwise supported by the track 242 for engaging and supporting the track 244 and cause it to rotate about the track frame. For example, a sprocket 246 is supported by the track frame 242 and engages the endless track 244 to cause the endless track to rotate about the track frame. An idler 245 is held against the track 244 by a tensioner (not shown) to maintain proper tension on the track. The track frame 242 also supports a plurality of rollers 248, which engage the track and, through the track, the support surface to support and distribute the weight of the excavator 200. An upper track guide 249 is provided for providing tension on track 244 and prevent the track from rubbing on track frame 242.

A second, or lower lift arm 330 is pivotally attached to the lower frame 212. A lower lift arm actuator 332 is pivotally coupled to the lower frame 212 at a first end 332A and to the lower lift arm 330 at a second end 332B. The lower lift arm 330 is configured to carry a lower implement 334. The lower implement 334 can be rigidly fixed to the lower lift arm 330 such that it is integral to the lift arm. Alternatively, the lower implement can be pivotally attached to the lower lift arm via an implement interface, which in some embodiments can include an implement carrier of the type described above. Lower lift arms with implement interfaces can accept and secure various different types of implements thereto. Actuation of the lower lift arm actuator 332, in response to operator input, causes the lower lift arm 330 to pivot with respect to the lower frame 212, thereby raising and lowering the lower implement 334.

Upper frame portion 211 supports cab 252, which defines, at least in part, operator compartment or station 250. A seat 254 is provided within cab 252 in which an operator can be seated while operating the excavator. While sitting in the seat 254, an operator will have access to a plurality of operator input devices 256 that the operator can manipulate to control various work functions, such as manipulating the lift arm 230, the lower lift arm 330, the traction system 240, pivoting the house 211, the tractive elements 240, and so forth.

Excavator 200 provides a variety of different operator input devices 256 to control various functions. For example, in some embodiments, hydraulic joysticks are provided to control the lift arm 230 and swiveling of the house 211 of the excavator. Such hydraulic joysticks are typically in hydraulic communication with valves to control the flow of pressurized fluid to hydraulic actuators in response to activation of the joysticks in certain conditions. In other embodiments, electric joysticks can be used to provide signals indicative of an operator's request to control various actuators. Foot pedals with attached levers are provided for controlling travel and lift arm swing. Electrical switches are located on the joysticks for controlling the providing of power to an implement attached to the implement carrier 272. Other types of operator inputs that can be used in excavator 200 and other excavators and power machines include, but are not limited to, switches, buttons, knobs, levers, variable sliders and the like. The specific control examples provided above are exemplary in nature and not intended to describe the input devices for all excavators and what they control.

Display devices are provided in the cab to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can be dedicated to provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided.

The description of power machine 100 and excavator 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on an excavator such as excavator 200, unless otherwise noted, the concepts discussed below are not intended to be limited in their application to the environments specifically described above.

Figure 4:
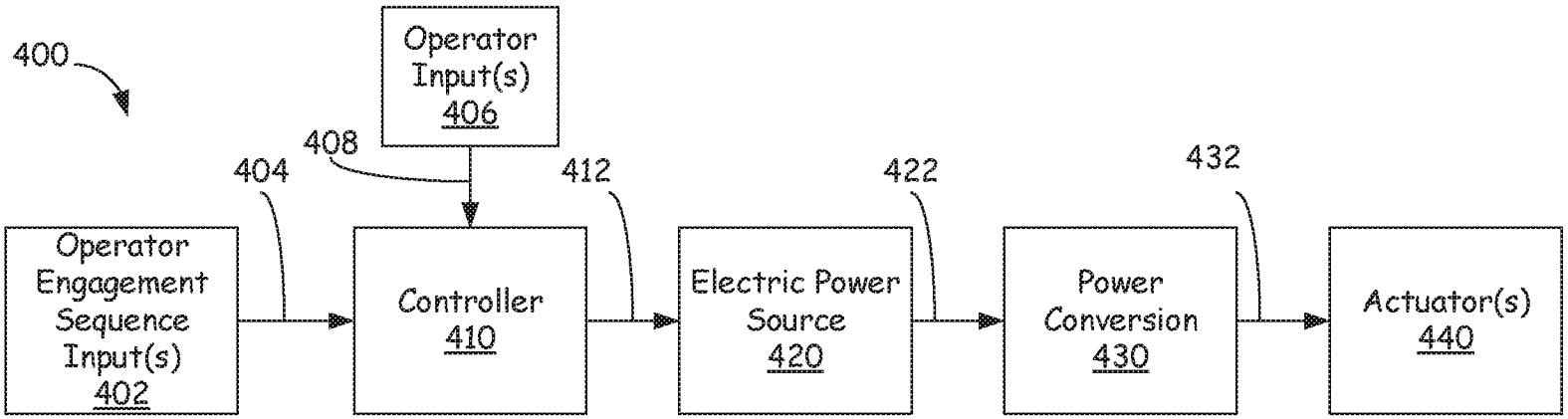
FIG. 4 is a block diagram illustrating certain functional systems, of a representative power machine utilizing an electric power source that enable powering of travel or other functions once an operator has performed an initialization routine according to one illustrative embodiment.

Referring now to FIG. 4, a block diagram illustrates portions of a power machine 400 that can be similar to one or both of the power machines 100 and 200 discussed above. Power machine 400 can be, for example, an electro-hydraulic power machine in which a hydraulic system is driven by an electric or hybrid electric powertrain. As is mentioned above and in the discussion of some embodiments below, power machines such as power machine 400 can include one or more batteries as an electric power source. Alternatively, the power machine 400 and rely on an external power source and an electrical cord (neither shown) that is coupled to both the external power source and the power machine to provide electrical power to the power machine. In some instances, the power cord provides power to a power machine that does not have a battery or other storage device located on the machine. In other instances, the power cord can be provided to charge an electrical storage device on the machine while the machine is being operated.

As discussed below, power machine 400 and other disclosed embodiments provide immobilization of certain power machine functions, particularly electro-hydraulically powered machine functions, in certain defined states or conditions and enablement of these certain power machine functions in other defined states or conditions. For example, in an excavator, functions such as boom and arm operation, blade operation, swing motion of the boom, rotation of the house, and/or travel can be disabled or immobilized under certain conditions where the operator leaves the operator station or is otherwise out of a required position or has not performed an initialization routine to enable the functions. Such disabling of certain functions is achieved in a manner that potentially allows the hydraulic system to be simplified as compared to conventional hydraulic systems that have included hydraulic enablement functionality. This potentially lowers the cost of the hydraulic system by eliminating components, lowers a required number of hydraulic connections which reduces the potential for leakages, and reduces the space requirement of the hydraulic system.

To accomplish these or other advantages, disclosed embodiments utilize an electric powertrain energy cut-off instead of utilizing a hydraulic enablement valve such is conventionally used in power machines with an internal combustion engine that drives a pump continuously during machine operation. Because it is possible to easily start and stop an electric motor, as opposed to an engine in an engine-based powertrain, which typically would run continuously during potential operation of the power machine, energy for the electric powertrain can be selectively supplied through a controller when the operator has not performed the initialization routine or has performed an action that would require that the initialization routine be performed again to enable certain machine functions.

As shown in FIG. 4, power machine 400 includes a controller 410 configured to generate control signals 412 that control an electric power source 420, which can be one of the types of electric power sources or arrangements discussed above. As such, electric power source 420 can include one or more batteries providing electric power. Electric power source 420 provides an output 422 to power conversion system 430 that is configured to utilize power from the power source to provide power signals 432 to actuators 440 (such as travel motors, lift or tilt cylinders, etc.). In exemplary embodiments, power conversion system 430 is configured to convert the power from power source 420 into signals in the form of pressurized hydraulic fluid for powering hydraulic actuators. As such, power conversion system 430 can include one or more hydraulic motors driven by an electric motor of electric power source 420. Power conversion system 430 can also include valves and other components used to control the application of hydraulic power to actuators 440.

As also shown in FIG. 4, power machine 400 includes one or more operator engagement sequence inputs 402 configured to provide enablement signals 404 indicative of whether the operator is engaged or positioned such that machine functions can be activated or enabled, or whether the operator is not properly engaged such that machine functions must be immobilized, prevented from activation, or unpowered. For instance, operator engagement sequence inputs 402 can include an operator seat or position sensor that detects whether the operator is seated properly within the operator cab or station. Inputs 402 can also or alternatively include other types of inputs, such as safety bar position inputs for loaders or other types of machines, seat belt engagement sensors, push button or other inputs that require the operator to complete a sequence of actions from a particular position, for example. This sequence of actions can be an initialization sequence of the type discussed above. Enablement signals 404 are provided to and received by controller 410, as are outputs 408 from operator inputs 406, which can be used to command machine functions through actuators 440 such as boom and arm operation, blade operation, swing motion of the boom, rotation of the house, and/or travel. Controller 410 is configured such that, unless enablement signals 404 are indicative of a proper operator enablement action (e.g., operator properly seated, seat belt engaged, etc.), controller 410 does not allow power to be provided to some or all power machine actuators 440, even when operator inputs 406 are manipulated to command usage of the actuators. If enablement signals 404 are indicative of a proper operator enablement action, controller 410 controls the electric power source 420 to provide power to the actuators through power conversion system 430. In some embodiments, the enablement signals may be required to be received in a particular order (for instance, an operator may be required to fasten a seat belt and then engage an operator input. For the purposes of this discussion, reception of the one or more signals are collectively referred to as reception of the enablement signals 404. Reception of the proper signals and (if necessary) in the proper order or subject to some other constraint is considered to be a proper operator engagement operation. In addition, actuation of a keyswitch, button, or other input to start a controller may be considered an enablement signal in some embodiments and may also be important to determine a proper order. However, a proper operator enablement action, for the purposes of this discussion, cannot include only a keyswitch or similar input. In some embodiments, the controller 410 can provide status information to a display or other operator interface to inform an operator of the status of the power machine vis-à-vis the enablement action. In other words, the display can provide an indication to the operator (in the form of visual and/or audible indicators, for example) that the operator has, or has not provided a proper operator enablement action. This can be useful to inform the operator as to whether the machine is functional but in need of a proper operator enablement action if the machine is not responding to other operator inputs.

By configuring controller 410 to control application of power from electric power source 420 based upon whether the operator performs the proper engagement or initialization sequence, actuators 440 can be prevented from receiving hydraulic or other power, without requiring the use of engagement valves to divert or block hydraulic flow from the actuators when the proper engagement sequence has not been performed. This allows for a simplified hydraulic system as described above, potentially reducing costs, space requirements and leakage. At the same time, in contrast to conventional systems in which an engine is powering the hydraulic system even when flow of hydraulic fluid is diverted from powering actuators 440, in system 400 the controller controls the electrical power source such that battery power is not utilized to power the hydraulic system when the proper engagement sequence has not been performed.

Figure 5:
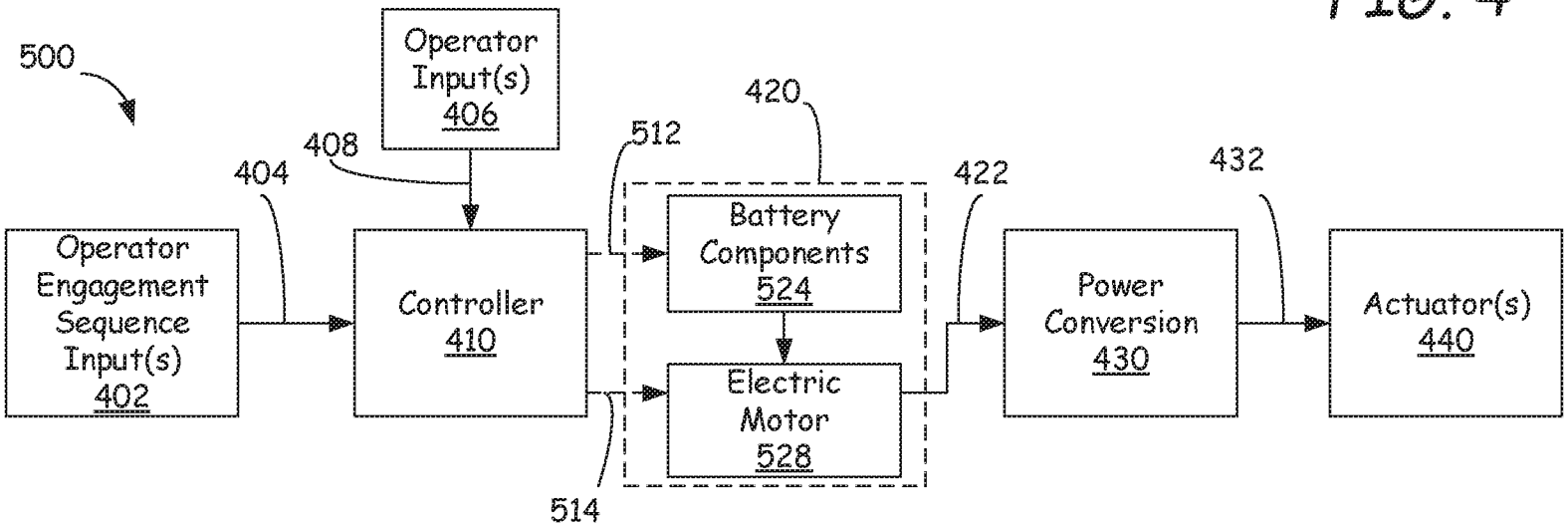
FIG. 5 is a block diagram illustrating one more particular embodiment of the power machine shown in FIG. 4.

Referring now to FIG. 5, shown is a power machine 500 that is one more particular embodiment of power machine 400 discussed above. In this embodiment, electric power source 420 is shown to include battery components 524 and an electric motor 528 powered by energy from the battery components. Electric motor 528 provides an output (e.g., in the form of a rotating shaft) which power conversion system 430 uses to provide power to actuators 440. The battery components 524 can include, for example, one or more batteries or battery packs and switching or control circuitry for selectively providing power from the batteries to electric motor 528. Electric motor 528 can similarly include switches and other control circuitry for selectively allowing power from the batteries to be provided to the motor. In various exemplary embodiments, controller 410 can therefore generate the control signals 412 (shown in FIG. 4) to control electric power source 420 by generating control signals 512 to control the battery components 524 (e.g., control switches of the battery components) or by generating control signals 514 to control the electric motor 528. In either instance, based upon control from controller 410, when operator engagement sequence inputs 402 do not indicate that a proper engagement sequence has occurred, power from the batteries is not used to power the electric motor. This both accomplishes the lockout and enablement of certain machine functions as discussed and reduces power consumption during the lockout of those functions.

Figure 6:
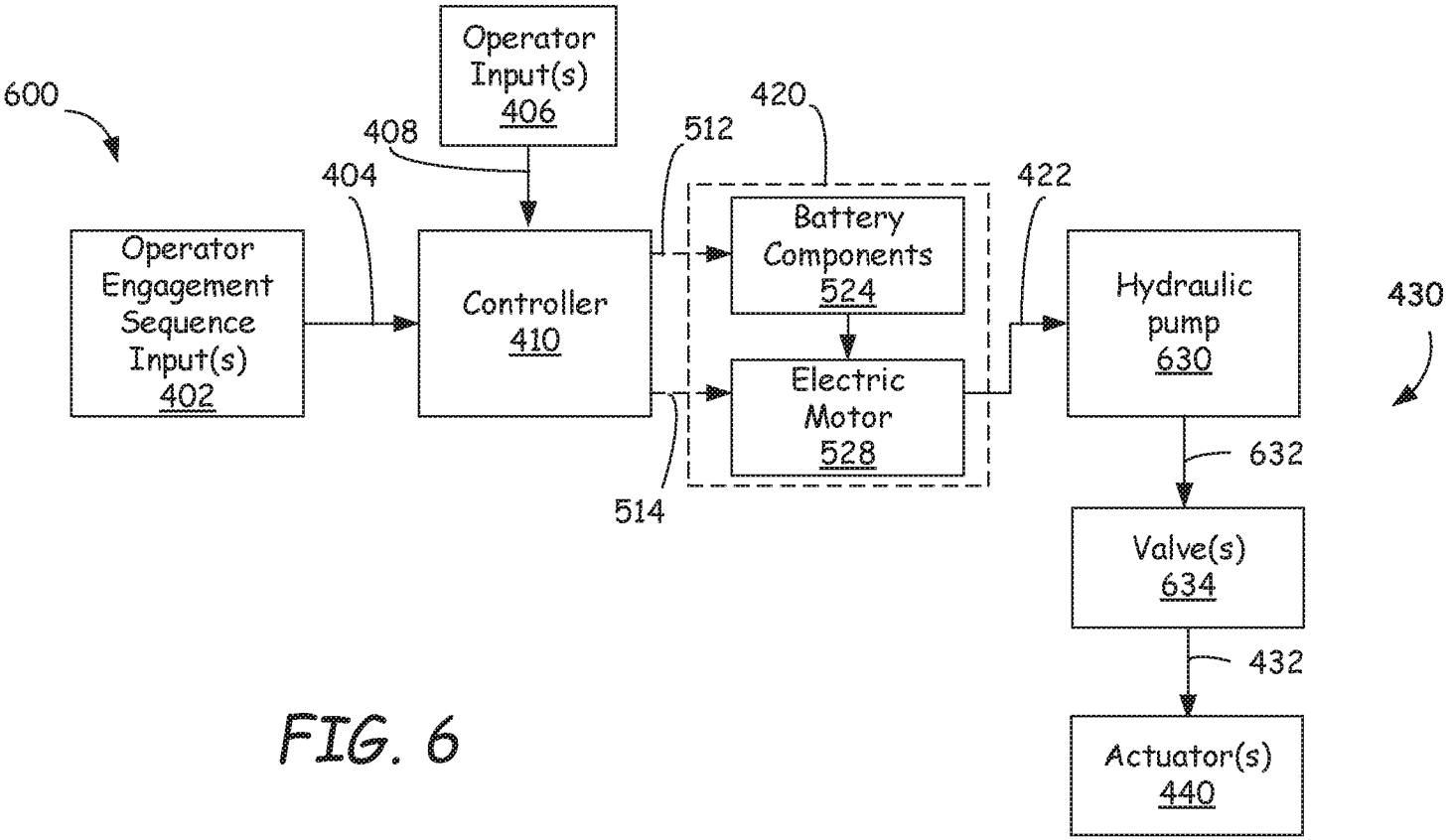
FIG. 6 is a block diagram illustrating another more particular embodiment of the power machine shown in FIG. 4.

Referring now to FIG. 6, shown is a power machine 600 which is one more particular embodiment of power machines 400 and 500 discussed above. In power machine 600, power conversion system 430 is shown to include at least one hydraulic pump 630 that is powered by output 422 from electric motor 528 to provide a pressurized hydraulic fluid output 632. Power conversion system 430 can also include one or more valves 634 to control the application of the pressurized fluid to the actuators responsive to operator inputs 406.

Although the present invention has been described with reference to preferred embodiments, workers skilled in the art will recognize that changes may be made in form and detail without departing from the scope of the discussion.

What is claimed is:

1. A power machine comprising:

a frame including an operator station configured to provide an operating position for an operator of the power machine;

at least one actuator configured to perform a machine work function;

an operator input configured to be manipulated by the operator and to responsively provide an operator command signal to command usage of the at least one actuator to perform the work function;

an electric power source supported by the frame and operably coupled to the actuator and configured to selectively provide a power source output to the actuator, wherein the power source output of the electric power source comprises a rotating shaft of an electric motor;

a controller configured to receive the operator command signal and at least one enablement signal and determine whether an operator has performed a proper enablement action, and to responsively provide control signals to the electric power source to control the power source output, wherein the controller is further configured such that if the enablement signal is indicative of a proper operator enablement action, the controller generates, responsive to the operator command signal commanding usage of the at least one actuator, the control signals to control the electric power source to provide power signals to the at least one actuator and perform the commanded usage of the at least one actuator, wherein the controller is further configured such that if the enablement signal is not indicative of the proper operator enablement action, the controller generates the control signals to control the electric power source to not provide power signals to the at least one actuator regardless of the commanded usage indicated by the operator command signal; and a power conversion system that is coupled to the rotating shaft and configured to provide power signals in the form of pressurized hydraulic fluid to the at least one actuator.

2. The power machine of claim 1, wherein the power conversion system includes:

a hydraulic pump coupled to the rotating shaft of the electric motor and configured to provide the pressurized hydraulic fluid; and a hydraulic valve coupled to the hydraulic pump and configured to control the application of the power signals to the at least one actuator responsive to the operator command signal.

3. The power machine of claim 1, wherein the electric power source further comprises battery components coupled to the electric motor, and including control signals to control the electric motor.

4. The power machine of claim 1, wherein the at least one enablement signal is provided by at least one of an operator seat or position sensor, a safety bar position sensor, and a seat belt engagement sensor.

5. The power machine of claim 1, wherein the at least one enablement signal is provided by a sensor or input device positioned in the operator station and configured to provide the at least one enablement signal as an indication of the operator's presence in the operator station.

6. The power machine of claim 2, wherein the controller is further configured such that if the operator command signal is indicative of no manipulation by the operator, the controller generates the control signals to control the electric power source to not provide power regardless of the enablement signal.

7. The power machine of claim 1 and further comprising an operator interface configured to alert the operator of a status of the enablement signal.

8. A power machine comprising:

at least one hydraulic actuator configured to perform a machine work function;

an operator input configured to be manipulated by an operator and to responsively provide an operator command signal to command usage of the at least one actuator to perform the work function;

an operator engagement sequence input configured to provide an enablement signal indicative of whether the operator is engaged or positioned such that machine work function can be activated or enabled;

an electric power source including an electric motor and configured to provide a power source output in the form of a rotating shaft;

a power conversion system coupled to the rotating shaft and configured to selectively provide power signals in the form of pressurized hydraulic fluid to the at least one hydraulic actuator to cause the at least one actuator to perform the machine work function; and a controller configured to receive the operator command signal and the enablement signal and to responsively provide control signals to the electric power source to control the power source output, wherein the controller is further configured such that if the enablement signal is indicative of a proper operator enablement action, the controller generates the control signals, responsive to the operator command signal commanding usage of the at least one actuator, to control the electric power source to provide power to the power conversion system to provide the power signals to the at least one actuator and perform the commanded usage of the at least one actuator, and wherein the controller is further configured such that if the enablement signal is not indicative of the proper operator enablement action, the controller generates the control signals to control the electric power source to not provide power to the power conversion system regardless of the commanded usage indicated by the operator command signal.

9. The power machine of claim 8, wherein the power conversion system comprises a hydraulic pump coupled to the rotating shaft of the electric motor and configured to provide the pressurized hydraulic fluid.

10. The power machine of claim 9, wherein the power conversion system further comprises a hydraulic valve coupled to the hydraulic pump and configured to control the application of the power signals to the at least one hydraulic actuator responsive to the operator command signal.

11. The power machine of claim 9, wherein the electric power source further comprises battery components coupled to the electric motor and configured to provide electric power to the electric motor, and wherein the control signals include control signals to control the electric motor.

12. The power machine of claim 9, and further comprising a frame including an operator station configured to provide an operating position for an operator of the work machine, wherein the operator input is positioned in the operator station.

13. The power machine of claim 12, wherein the at least one operator engagement sequence input is configured to provide the enablement signal as an indication of the operator's presence in the operator station.

14. The power machine of claim 13, wherein the at least one operator engagement sequence input comprises at least one of an operator seat or position sensor, a safety bar position sensor, and a seat belt engagement sensor.

* * * * *